US005440667A

United States Patent [19]

Simpson et al.

[11] Patent Number: 5,440,667

[45] Date of Patent: Aug. 8, 1995

[54] OHMIC HEATER INCLUDING ELECTRODES ARRANGED ALONG A FLOW AXIS TO REDUCE LEAKAGE CURRENT

[75] Inventors: David P. Simpson, Chester; Robert Stirling, Wirral, both of United Kingdom

[73] Assignee: Electricity Association Technology Limited, United Kingdom

[21] Appl. No.: 986,742

[22] Filed: Dec. 8, 1992

Related U.S. Application Data

[63] Continuation-in-part of Ser. No. 645,492, Jan. 24, 1991, abandoned.

[30] Foreign Application Priority Data

Apr. 10, 1990 [GB] United Kingdom ..... 90 08 095.3

[51] Int. Cl.[6] ..... H05B 3/03; H05B 1/02

[52] U.S. Cl. ..... 392/314; 392/318; 392/312; 219/509; 361/42

[58] Field of Search ..... 392/311–338; 219/509, 481; 361/42

[56] References Cited

U.S. PATENT DOCUMENTS

| | | | |
|---|---|---|---|
| 731,339 | 6/1903 | Chapman | 392/314 |
| 938,127 | 10/1909 | Denhard | 392/320 |
| 1,132,604 | 3/1915 | Nash | 392/320 |
| 1,327,774 | 1/1920 | Plante | 392/320 |
| 1,696,828 | 12/1928 | Price-Williams | 392/320 |
| 2,324,837 | 7/1943 | Hall | 392/321 |
| 2,663,788 | 12/1953 | Tatem . | |
| 2,680,802 | 6/1954 | Bremer et al. | 392/321 |
| 3,488,474 | 1/1970 | Saunders . | |
| 3,520,979 | 7/1970 | Scarfe et al. . | |
| 3,760,298 | 9/1973 | Pell | 361/42 |
| 3,983,359 | 9/1976 | Walker et al. | 392/314 |
| 4,743,998 | 5/1988 | Wu | 361/42 |

FOREIGN PATENT DOCUMENTS

| | | | |
|---|---|---|---|
| 18971 | 11/1935 | Australia | 392/314 |
| 211686 | 11/1957 | Australia | 392/317 |
| 23213 | 6/1972 | Australia | 392/34 |
| 907192 | 3/1946 | France | 392/314 |
| 964733 | 2/1950 | France . | |
| 734486 | 4/1943 | Germany . | |
| 909379 | 4/1954 | Germany . | |
| 234087 | 10/1925 | United Kingdom . | |
| 389571 | 3/1933 | United Kingdom . | |
| 640608 | 7/1950 | United Kingdom | 392/314 |
| 2268671 | 1/1994 | United Kingdom | 392/338 |
| 683034 | 8/1979 | U.S.S.R. | 392/320 |

*Primary Examiner*—John A. Jeffery
*Attorney, Agent, or Firm*—Beveridge, DeGrandi, Weilacher & Young

[57] ABSTRACT

An ohmic heater comprises at least two electrodes contained within a vessel such that the electrodes lie along the length of the vessel. The vessel has inlet and outlet ports in the top and bottom through which a fluid to be heated flows, passing through the vessel along the length of the vessel. The electrodes are equally spaced about the axis of the vessel and when in use, are each connected to a single phase of a power supply, such that the total voltage at any point in time at the electrodes is near or at a neutral potential of the electric power supply. Electrically conductive guard rings are positioned around the inner periphery of the inlet and outlet ports of the vessel and are connected to the neutral potential of the electric power supply by electrical connectors. A leakage current monitor is interposed between guard rings and the neutral potential to enable current leakage from said heater to be monitored. In use, a current passes perpendicular to the flow of the fluid, but the electric potential on the axis is near to neutral, and hence the leakage current from the ohmic heater is substantially reduced.

20 Claims, 6 Drawing Sheets

OHMIC HEATER INCLUDING ELECTRODES ARRANGED ALONG A FLOW AXIS TO REDUCE LEAKAGE CURRENT

RELATED APPLICATION DATA

This patent application is a continuation-in-part of U.S. Patent Application Ser. No. 07/645,492 filed 24th Jan. 1991, now abandoned, which U.S. application is based on United Kingdom Patent Application No. 9008095.3, filed in the United Kingdom on 10th Apr. 1990. Each of these applications is entirely incorporated herein by reference.

BACKGROUND OF THE INVENTION

1. Field of the Invention

This invention relates to an ohmic heater, which heats a fluid by passing an electric current through the fluid. This type of heater is used for fluids which require heating but which might foul or block conventional heaters.

2. Description of Prior Art

Arrangements are known where the current is passed longitudinally or in the direction of flow of the fluid. However, in these systems, due to the uneven flow of the fluid in the container, there is uneven heating of the fluid.

Also known are transverse ohmic heaters in which the current is passed between electrodes transversely, or perpendicular to the flow of the fluid. However, in such arrangements, some of the current may flow to earthed components in the apparatus such as the ends of the connecting pipes to and from the heater. This is termed a leakage current, and can give rise to unacceptably high levels of electrolytic corrosion or fouling of the pipe ends which carry these currents.

SUMMARY OF THE INVENTION

The present invention includes an ohmic heater for heating a fluid comprising a vessel having inlet and outlet ports between which said fluid flows when in use, along an axis. At least two electrodes are arranged to be equally spaced about said axis of flow and contained within said vessel. A single phase of an electric power supply is supplied to each said electrode such that the electric potential at any time on said axis is substantially at the neutral potential of the power supply. An electrically conductive guard ring exposed to the flow of fluid is positioned to lie around the inner periphery of each of the inlet and outlet ports and the guard rings are connected to the neutral potential of the power supply by electrical connectors. A leakage current monitor is interposed between guard rings and the neutral potential to enable leakage current from the heater to be monitored.

This arrangement has the advantage in that the fluid along the axis of flow is maintained at or near neutral potential, so that current leakage to pipe ends is significantly reduced. The leakage current is monitored so that if it exceeds a threshold the heater can be switched off.

Preferably, the vessel is electrically insulating and said electrodes are adjacent to the walls of the vessel. Said electrodes may be arranged to extend parallel to said axis of said fluid flow where electrical conductivity of the fluid remains relatively constant along the length of the electrodes, in the flow direction, in order to provide a uniform current density over the length.

Alternatively said electrodes may be arranged such that their separation transverse to said axis increases along said axis in the direction of flow of said fluid. This arrangement compensates for the linear increase in conductivity with temperature by increasing the separation of the electrodes, thus maintaining a uniform current density over the length.

BRIEF DESCRIPTION OF THE DRAWINGS

Examples of the invention will now be described with reference to the accompanying drawings, in which.

DETAILED DESCRIPTION OF THE PREFERRED EMBODIMENTS

Figure 1:
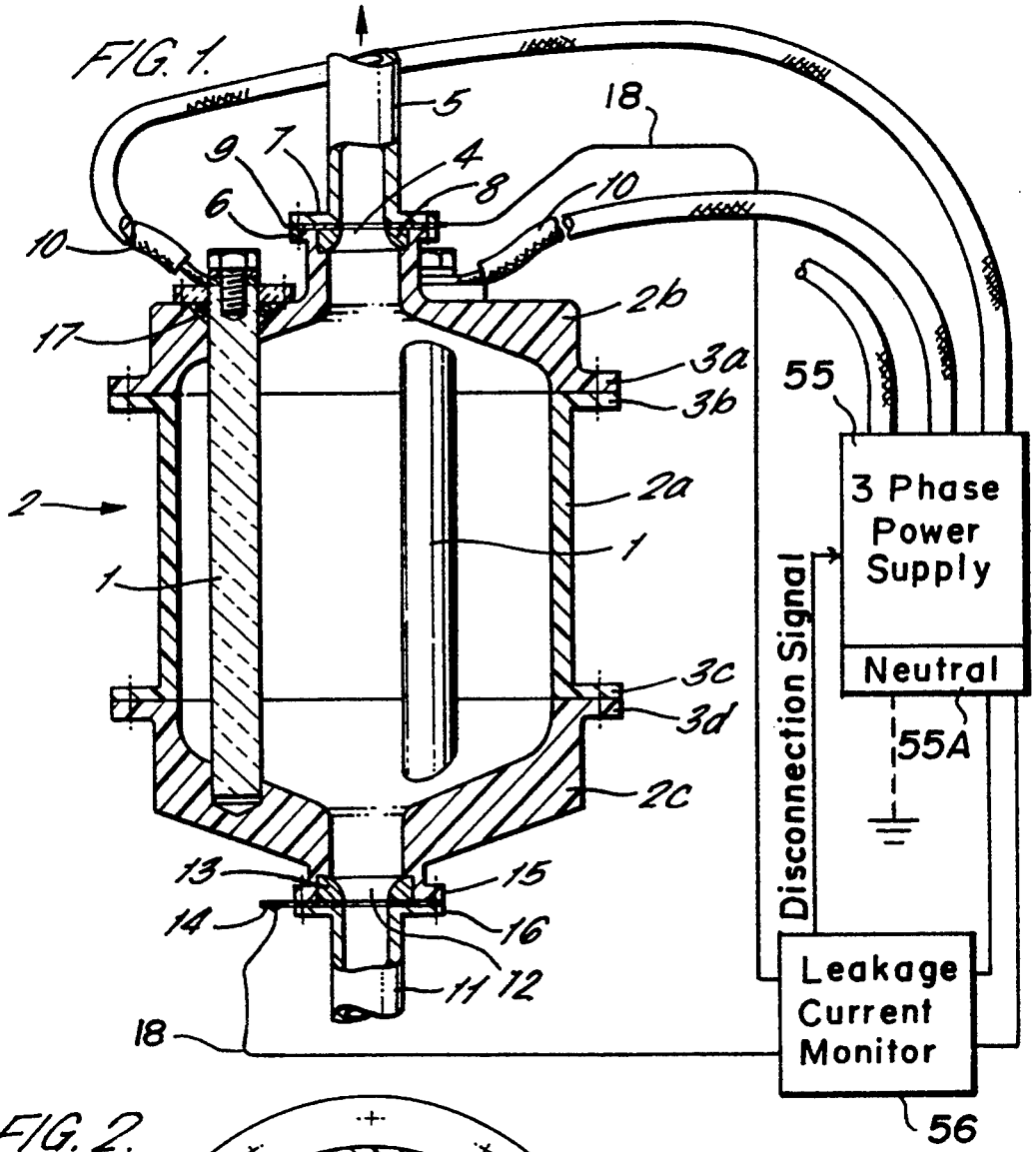
FIG. 1 is a longitudinal sectional view of an ohmic heater according to one embodiment of the present invention.
Figure 2:
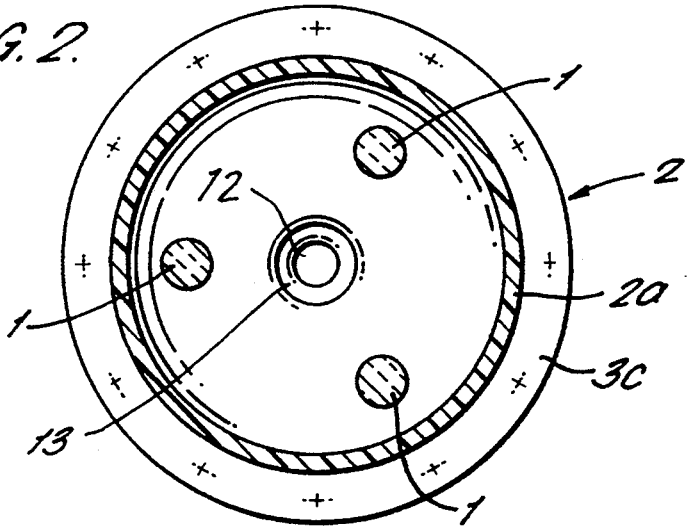
FIG. 2 is a cross-sectional view of an ohmic heater according to the embodiment illustrated in FIG. 1.

Referring now to FIGS. 1 and 2, these drawings illustrate an embodiment of the present invention in which electrodes 1 are arranged to be parallel to the flow of the fluid to be heated.

The vessel 2 comprises three parts: a cylindrical main body 2*a*, a top end plate 2*b* and a bottom end plate 2*c*. The top end plate 2*b* has a flange 3*a* which is connected to an upper flange 3*b* of the cylindrical main body 2*a*, by bolts. The bottom end plate 2*c* has a flange 3*d* that is connected to a lower flange 3*c* of the cylindrical main body 2*a*, also by bolts. The three parts are thus joined together to form the watertight vessel 2.

The vessel 2 is constructed from a suitable electrically-insulating material and of such wall thickness as to adequately withstand the internal pressures applied or generated in the heater—for example by any tendency for the heated fluid to boil.

The top end plate 2*b* has a outlet port 4 in the centre. The internal surface of the top end plate 2*b* tapers from the internal diameter of the cylindrical main body 2*a* to the diameter of the outlet port 4. The outlet port 4 is arranged to form a connection with an output pipe 5 by the coupling of flanges 6 and 7 of the outlet port 4 and the output pipe 5 respectively.

Surrounding the outlet port 4 within the flange 6, there is a guard ring 8 which is electrically connected to the neutral connection of a three phase power supply 55 by a metallic gasket 9 and connection 18.

At regular spacings around the upper surface of the top end plate 2*b*, upper ends of three rod shaped electrodes 1 project through the top end plate 2*b* into the vessel 2. The electrodes 1 and the top end plate 2*b* are sealed to prevent fluid loss from the vessel 2 by seals 17.

The electrodes 1 extend parallel to the axis of the vessel 2 and have opposite ends located in bores drifted in the interior face of the bottom and plate 2*c*. When in use, the electrodes 1 are electrically connected by wires 10 to a three-phase power supply (not shown). The electrodes 1 are equally spaced and in FIG. 2, they can be seen to lie at the apices of an equilateral triangle, wherein the centroid of the equilateral triangle falls at the axis of the vessel 2, which is also the axis of flow of the fluid to be heated.

The bottom end plate 2*c*, is of similar shape to the top end plate 2*a* and comprises an inlet port 12 with a guard ring 13, a metallic gasket 14 and a flange 15. The inlet port 12 is connected to an input pipe 11 by the connection of flanges 15 and 16 of the inlet port 12 and input pipe 11 respectively.

When in operation, a fluid to be heated is passed into the input pipe 11 and flows through the vessel 2 to the output pipe 5. The direction of flow of the fluid is indicated in the drawings by arrows. In order to heat the fluid uniformly, the electrical conductivity of the fluid must be relatively uniform over the length of the electrodes 1. This can be achieved either by selecting a fluid to be heated for which the electrical conductivity does not change very much over a wide temperature variation or by limiting the temperature range over which the fluid is heated, such that the change in electrical conductivity is small.

Whilst the fluid is passing the electrodes 1, the electrodes 1 are energised by connection to a three-phase power supply (not shown).

A convenient voltage to use may be 415 V. Given that the electrical conductivity of the fluid to be heated is substantially constant over any planar section of the heated volume taken at right angles to the axis of the vessel 2, equal phase to phase electrical currents will be maintained between these three electrodes 1 since they are disposed at equal separations. This provides balanced phase currents as required for a three-phase power supply.

A major advantage of this geometry, is that the centroid of the equilateral triangle formed by the three electrodes 1 will always be maintained at or very near the common electrically neutral voltage level of the three electrical phase voltages applied to the electrodes 1, if a current balance is maintained between them, in the manner explained above. The input and output pipes 11 and 5 are provided at each end of the vessel 2, coaxial with the vessel 2 and the centroid of the electrodes 1 and hence the axes of these pipes 5 and 11 will also lie along lines of the neutral electrical potential of the three phase power supply.

The neutral potential 552 of the power supply is near earth potential although not necessarily actually at earth potential. For instance for the three phase supply at 415 V mentioned hereinabove, the neutral potential may be typically 5 V relative to earth.

Although any conventional method of measuring and controlling the temperature of the fluid may be used, since the axis of the pipes 5 and 11 are maintained at or near earth potential, an earthed metal-clad thermocouple can be used in the outlet stream.

The dimensions of the apparatus are such that the mutual separation of the electrodes 1 in their triangular disposition is substantially greater than the diameters of the input and output pipes 11 and 5 and hence it is apparent that the voltage level corresponding to the periphery of these pipes 5 and 11 will be very low compared to the electrode voltages, and may, by suitable choice of dimensions, be reduced to an insignificant value. Thus, a small or even negligible leakage current could be constrained to flow to the pipes 5 and 11 in the end plates 2*b* and 2*c* of the vessel 2 from each electrode 1 as its voltage varies sinusoidally in time about a mean (zero) level corresponding to the axial voltage value of the vessel 2.

In practice such leakage currents, even if very small in proportion to the main ohmic heater current might give rise to unacceptably high levels of electrolytic corrosion or fouling of the pipes 11 and 5 which would carry these currents. To still further reduce the levels of these leakage currents, the metallic or conducting portion of the ends of the pipes 11 and 5 are connected to the end plates 2*b* and 2*c* at a suitable distance from the electrodes 1 thus increasing the current path length to this earthed region, and reducing the leakage current flowing in proportion. In addition, guard rings 8 and 13 of suitable material—which may be the same material used to form the electrodes of the heater—may be mounted over the end of each pipe 5 and 11 in such a way as to shield or screen the pipe material from carrying any current at all; all the leakage current flowing to the guard rings 8 and 13. It must be appreciated that with perfect phase-balance between the three main electrodes 1 of the ohmic heater and with identical electrode 1 to guard ring 8 and 13 distances, achieved by suitable ohmic heater geometry, any leakage current from each electrode 1 to the guard rings 8 and 13 at either end of the vessel 2 will be exactly equal in peak amplitude to that from any other electrode 1. Under these circumstances, it is a well-known feature of the balanced three-phase system that the net current flowing to the guard rings 8 and 13 will be zero—the incoming current from any electrode 1 will be exactly balanced by the sum of the outgoing current to the other two electrodes at any instant of time. It is desirable if possible for safety reasons for the mutual guard ring-/neutral connection to be the main earthing point of the ohmic heater. In any case if metallic pipe connections were to be used to the vessel 2, these would require to be earthed, and it would follow that the guard rings 8 and 13 can be electrically connected to these pipes and to earth.

Figure 7:
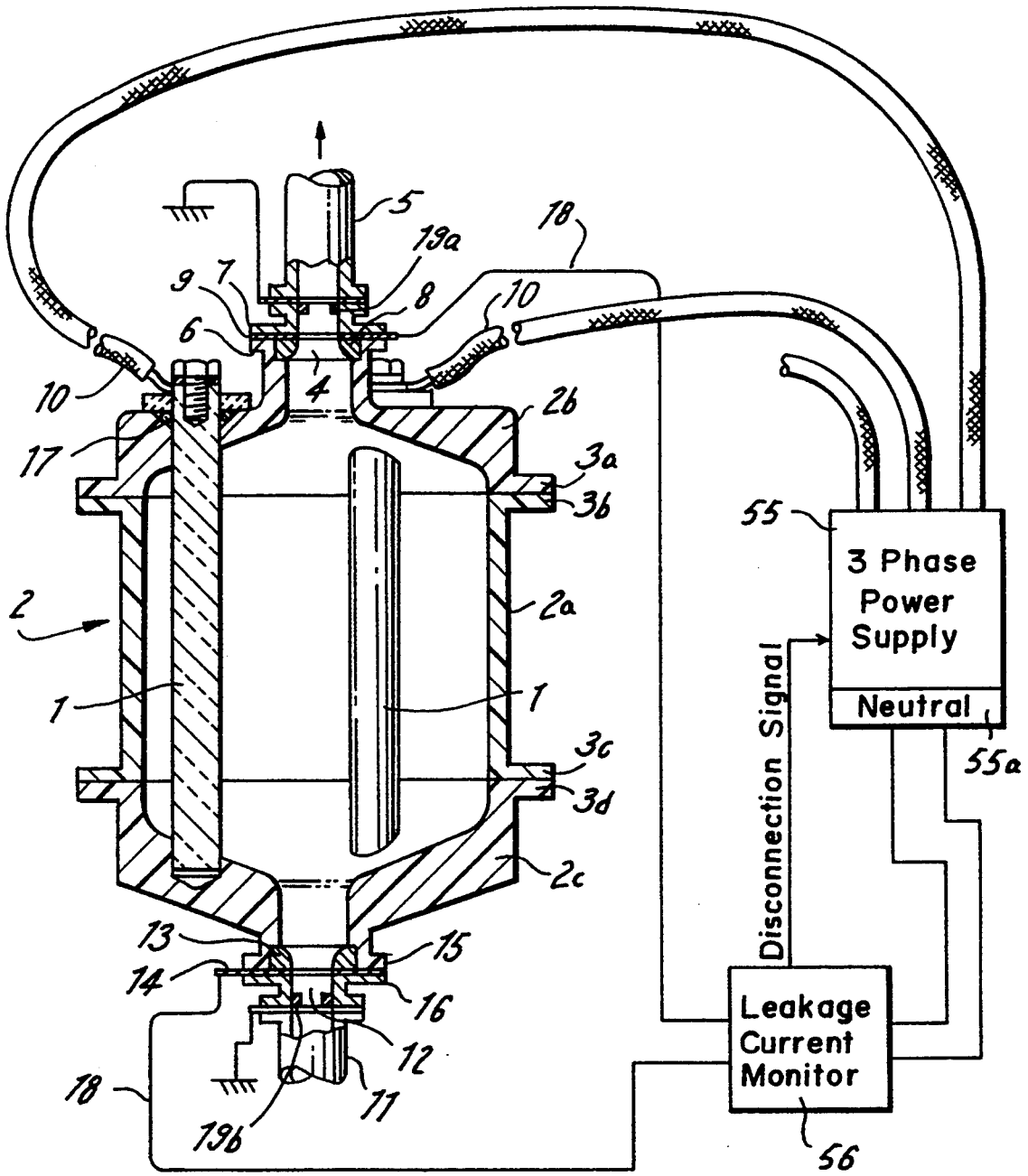
FIG. 7 is a cross-sectional view of an ohmic heater similar to that shown in FIG. 1 with additional earthed guard rings.

If the guard ring is not earthed then if metallic pipe connections are used these should be earthed. Alternatively, as shown in FIG. 7, second earthed guard rings 19*a* and 19*b* can be provided at positions further from the electrodes than the first guard rings 8 and 13. The earthed guard rings 19*a* and 19*b* are an important safety feature when non-conductive pipe connections are used.

The connection of the guard rings 8 and 13 to the neutral 550 of the three phase power supply 55 allows for the leakage current to be measured. If for instance there is a phase current imbalance, the electrical potential on the axis of flow will change and a leakage current from the heater will result. The leakage current will flow to the guard rings 8 and 13 since these are connected to the system neutral 550. By monitoring the current flowing between the guard rings 8 and 13 and the power supply neutral 550 with a leakage current monitor 56 the leakage current can be measured and if it is too large the heater can be switched off. Thus the monitoring of the leakage current can be used to identify a fault such as a fouled or defective electrode.

With a heater 50 mm in diameter and electrodes 1000 mm long at 100 mm centres, which dissipates approximately 20 kW at 415 V phase voltage the total leakage current from the heater according to the invention during normal operation was found by the inventors to be well below 1 mA, thereby supporting the claim that the leakage current to the earthed parts of the equipment via the heater fluid is negligible during normal operation.

The electrodes 1 and guard rings 8, 13, 19*a* and 19*b* may be made from any suitable material which is compatible with the chemical and electrochemical properties of the fluid to be heated. In general there will be an upper limit to the current density which any particular electrode material/working fluid will withstand without either damaging the current-carrying portion of the electrode or causing the fluid to decompose or otherwise react at the electrode surface and form a fouling deposit on the surface thus adversely affecting the operation of the ohmic heater. The dimensions of the ohmic heater, and in particular the mutual electrode 1 spacings and the electrode 1 to guard rings 8 and 13 distances will need to be chosen in such a way as to limit the currents flowing to levels which the electrode/fluid combination will withstand. Suitable electrode materials which will operate successfully with wide range of industrial fluids have been found to be platinized titanium and various graphite-based materials.

For fluids having electrical conductivities similar to those of standard tap water, suitable dimensions for the ohmic heater components may be electrode diameters of approximately 50 mm, at a mutual spacing of 100 mm between centres. The electrodes 1 might be contained in a tubular insulating housing some 200 mm in diameter and 1000 mm long. Pipes 5 and 11 to the ends of the heater of 25 mm diameter might be used, recessed approximately 50 mm into the insulating end plates 2*b* and 2*c* of the ohmic heater to reduce leakage currents. Such an ohmic heater would draw a balanced three-phase power totalling some 10 kW.

Figure 5:
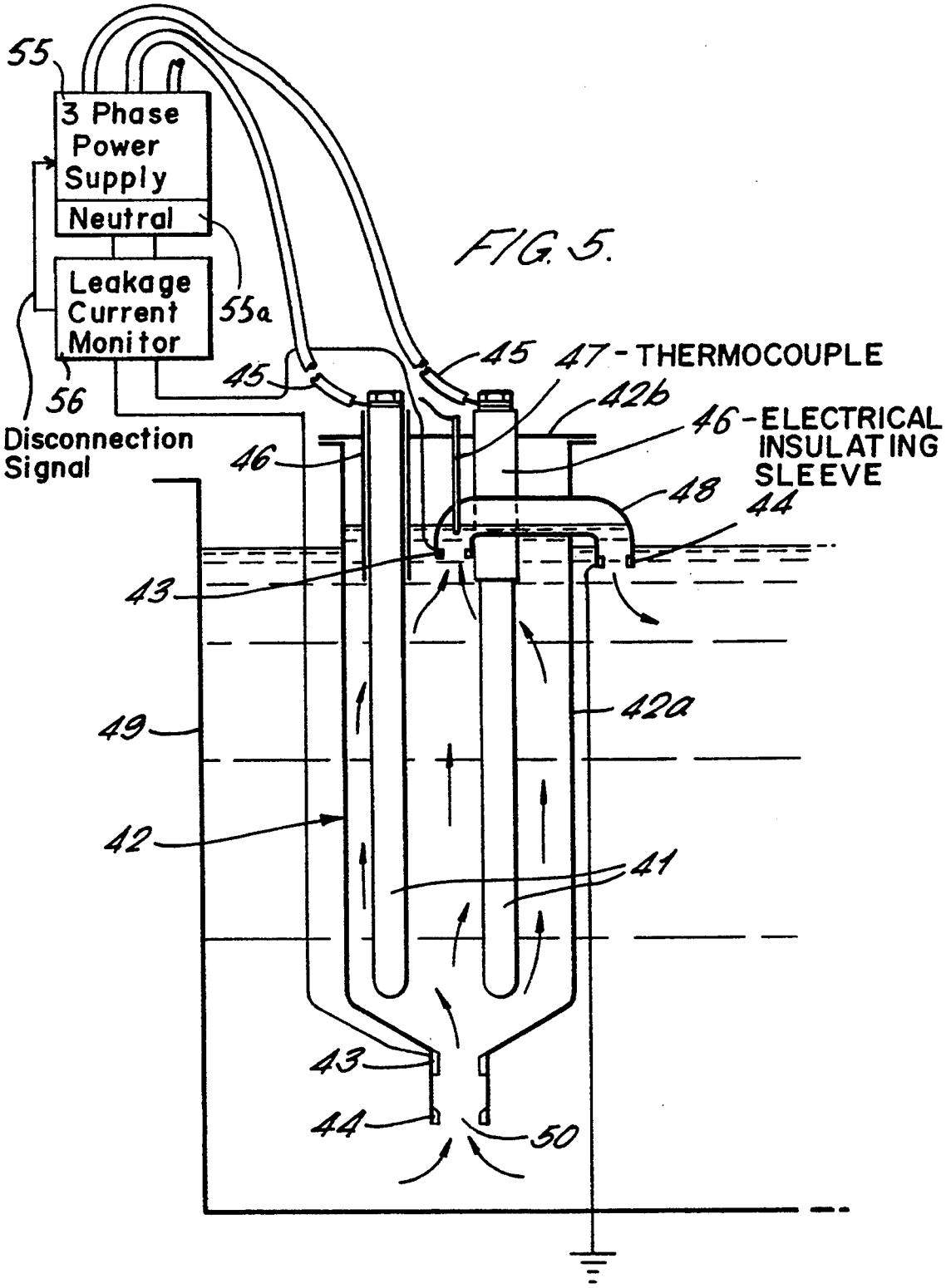
FIG. 5 is a longitudinal sectional view of an ohmic heater according to a still further embodiment of the present invention.

It has been found that a convenient method of adjusting the current flowing between the electrodes in this type of heater when the electrical conductivity of the heated fluid proves to be higher than expected is to apply an appropriate length of heat-shrinkable or other close-fitting insulating tubing to cover a defined length of each electrode. No deleterious effect on either the electrodes or the tubing material has been found in tests and the currents drawn from each phase of the supply can be adjusted easily and accurately. Such insulating tubing 46 is shown in FIG. 5 at the upper ends of the electrodes.

It has been found to be convenient to mount the vessel 2 of the ohmic heater with its axis vertical, so that any gases evolved in the heated volume may be easily swept out through the outlet port 4 of the vessel 2. Similarly, any solid particulates which may pass into the vessel 2 will tend to fall to the lower end of the vessel chamber, clear of the 415 V electrodes 1, thus obviating any tendency for such particulates to short out or reduce the resistance of the main current paths which provide the heating effect in the apparatus. In addition it is advantageous if the upper and lower end plates 2*b* and 2*c* of the vessel 2 are sloping as shown in FIG. 1, so the gas may more easily be swept out of the outlet port 4 and solids will tend to settle on the axis of the vessel 2 near the inlet port 12. The guard rings 8 and 13 at either end of the vessel 2 may be simply connected to neutral 550 by means of connections 18 and suitably shaped metallic gasket 9 and 14 interposed between the guard rings 8 and 13 and the pipe flanges 6, 7, 15 and 16 at either end of the vessel. Similarly the guard rings 19*a* and 19*b* can be connected to earth using such an arrangement. The three parts forming the vessel 2 may be constructed from suitable plastic material which will withstand the temperature and pressure conditions within the vessel, as well as any corrosive action of the heated fluid, or alternatively they may be constructed from glass or enamel lined steel in the case of particularly arduous operating conditions.

Figure 3:
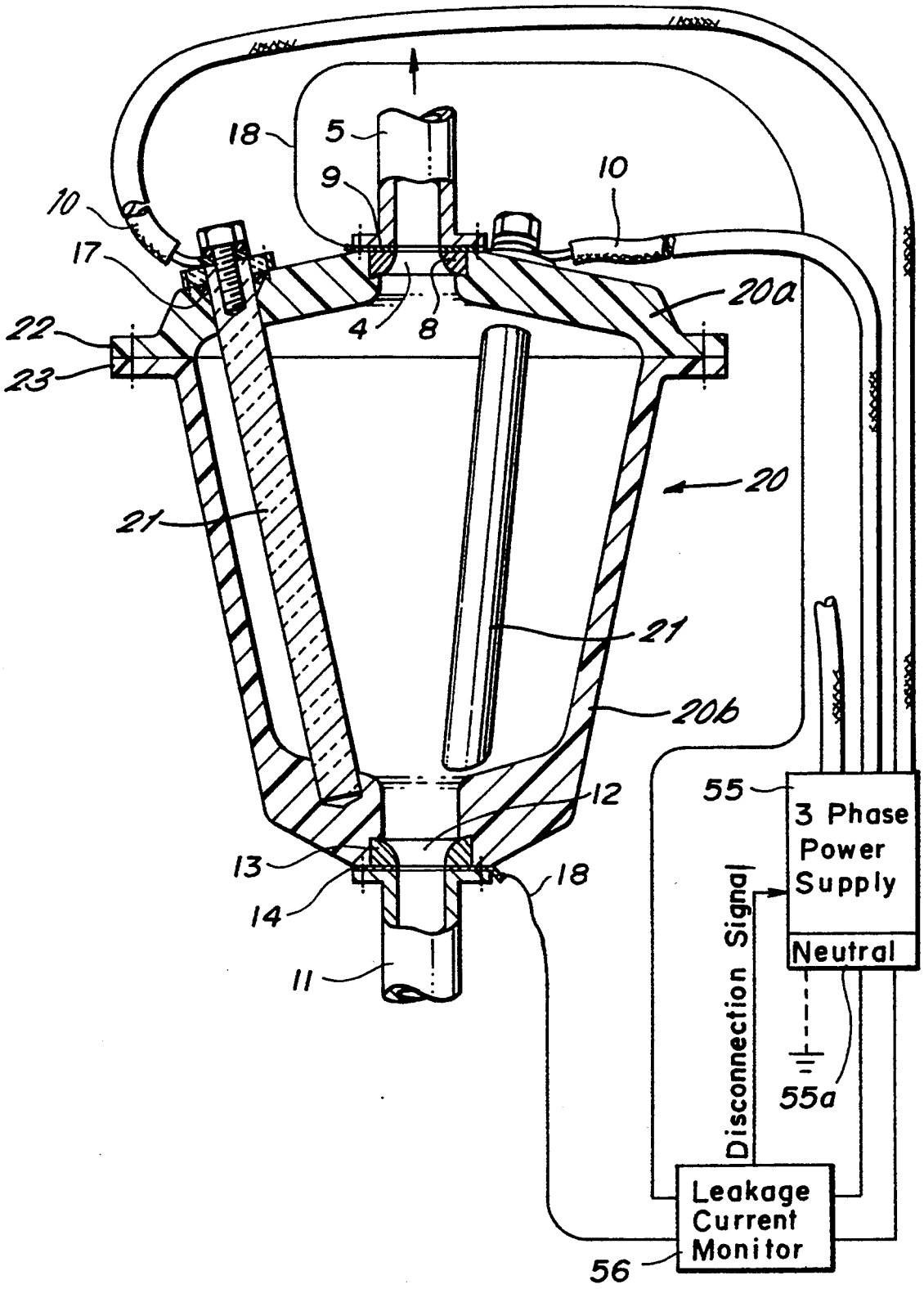
FIG. 3 is a longitudinal sectional view of an ohmic heater according to another embodiment of the present invention.

An example of another embodiment of the present invention is shown in FIG. 3. Many of the components of this embodiment are similar to those already described herein above for the previous embodiment. However, the vessel 20 comprises only two parts, an upper end plate 20*a* and a tapered main body 20*b*, joined together by bolts through flanges 22 and 23. In this embodiment, the separation of the three electrodes is increased as the heated fluid passes through the vessel 20 from bottom to top. In this way the current density at any point along the length of each electrode 21 can be maintained at the constant desired level even if the electrical conductivity of the heated fluid increases during its passage through the heater. The ratio of the pitch circle diameters of the upper and lower ends of the electrodes 21 should generally be equal to the ratio of the initial and final conductivities of the heated fluid, it being understood that the conductivity of fluids generally increases linearly with temperature so that the linearly-increasing spacing of the electrodes exactly compensates for this effect. The temperature of the heated fluid increases more or less linearly with distance during its passage along the length of the vessel 20.

Although only one guard ring is shown in each port of the arrangement of FIG. 3 a second earthed guard ring may be provided in a similar arrangement to that shown in FIG. 7.

Figure 4:
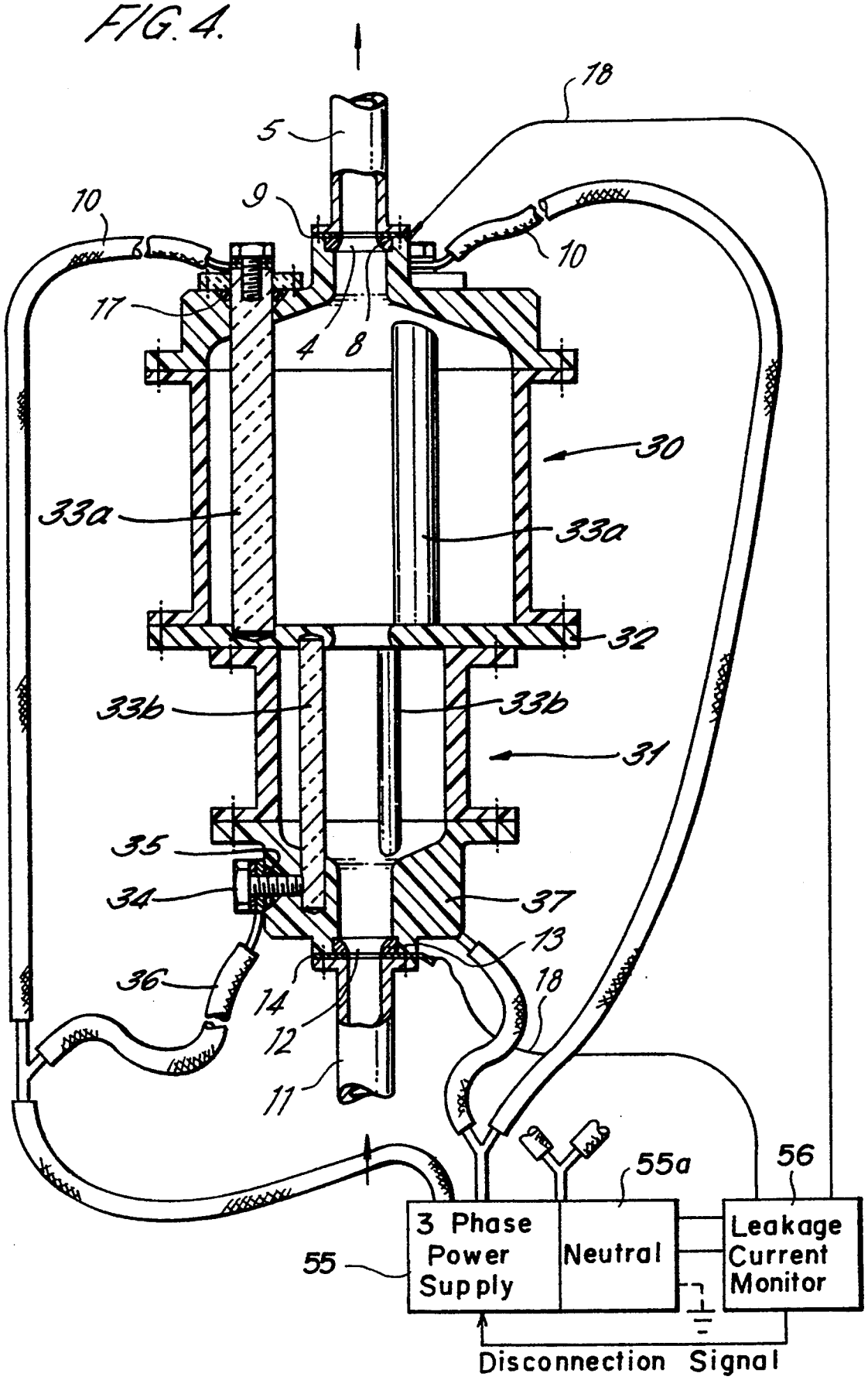
FIG. 4 is a longitudinal sectional view of an ohmic heater according to a further embodiment of the present invention.

A further embodiment of the present invention, where the conductivity changes significantly during the heating cycle is shown in FIG. 4. Here two vessels 30 and 31 of the same general type as shown in FIG. 1 but of different diameters to cope with the change in conductivity, are connected together by means of an adaptor plate 32 constructed from some suitable insulating material. If the geometrically correlating electrodes 33*a* and 33*b* in the two parts of the ohmic heater are connected to the same phase of the electrical supply, there will be no need to provide a guard ring at the adapter plate 32, since the current densities flowing in each part of the ohmic heater will be largely unaffected by the electrical conditions in the other part. In addition, FIG. 4 shows alternative means 34 and 35 of making the electrical connection to the lower electrodes 33*b*, and of sealing these connections against fluid leakage. Connecting pins 34 penetrate the bottom end plate 37 to connect perpendicularly with the lower end of the electrodes 33*b*. The head of the connecting pin 34 is connected to wires 36 to provide electrical continuity between the wires 36 and the electrodes 33*b*. The connecting pins 34 and the lower end plate 37 are sealed to prevent fluid loss by seal 35. As shown in FIG. 4 electrodes in geometrically equivalent positions in each vessel are electrically connected together.

If more than two heating stages or chambers are required, they can be added in series in a similar manner, with the electrical connections to the intermediate chambers being made radially through the appropriate adaptor plates. The surfaces of the adaptor plates 32 may also be shaped as described above in such a manner as to promote the egress of evolved gases or prevent the accumulation of solids at these plates 32.

Also in this embodiment earthed guard rings can additionally be provided in a similar arrangement to that shown in FIG. 7.

FIG. 5 shows a still further embodiment of the present invention. In this embodiment the versatility of the invention is illustrated in that the heater is used as a heater for tanks of liquid, as used in plating or phosphating baths. Conventionally heat exchanges are used for this application but these are subject to considerable fouling.

The vessel 42 is composed of a vessel body 42*a* and a vessel top plate 42*b*, and is suspended in a tank 49 of liquid. The electrodes 41 project through the top plate 2*b* into the vessel 42, and are connected to a three phase power supply 55 by wires 45.

There is no outlet port provided in the top plate 42*b* as in the previous embodiments. Instead there is an outlet pipe 48 provided within the vessel 42 to allow fluid at the top of the vessel 42 to be output through the wall of the vessel body 42*a*.

In the outlet pipe 48 and the inlet port 50 two sets of guard rings are provided 43 and 44. The guard rings nearest the electrodes are the neutral guard rings 43 whilst those furthest away are the earth guard rings.

In this embodiment of the invention circulation of the fluid is provided for by thermal siphoning, in that the circulation occurs due to the decrease in density of the fluid as its temperature rises. Therefore as the temperature of the fluid in the vessel increases it rises up to the outlet pipe 48 and is replaced at the inlet port 50 by cooler fluid.

A further feature is also illustrated in this embodiment. An earthed metal clad thermocouple 47 is used to measure the temperature of the fluid leaving the heater. The use of this is possible since the axis at the outlet pipe 48 is maintained at or near neutral potential as hereinbefore mentioned.

FIG. 5 also shows that electrode current adjusting insulating sleeves 46 as hereinbefore mentioned. The movement of these sleeves up or down the length the electrodes 41 (as shown by the double headed arrows in FIG. 5) varies the electrode currents.

Although in all of the embodiments hereinbefore mentioned the electrodes have been shown to lie within the vessel cavity, where viscous fluids are to be heated it may be advantageous to mount the electrodes against the insulating wall of the vessel. This is advantageous in that no area is provided behind the electrodes in which particulate matter in the fluid can be trapped.

Figure 6:
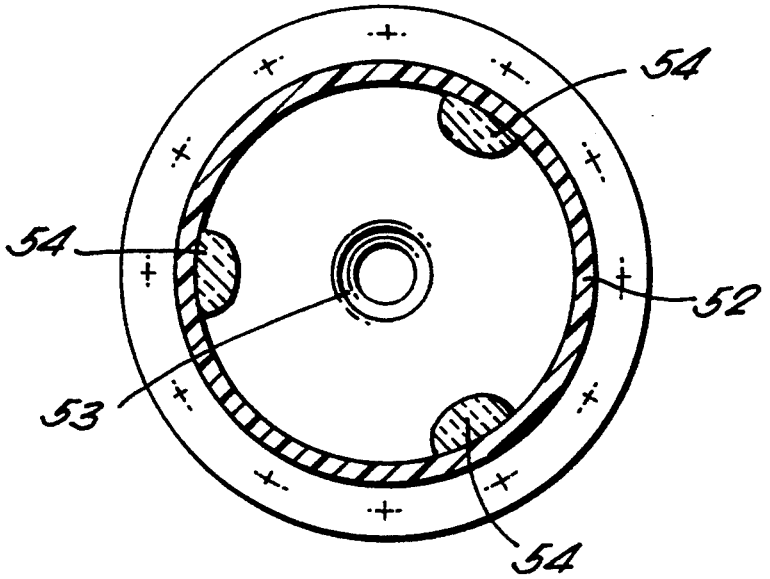
FIG. 6 is a cross-sectional view of an ohmic heater according to another embodiment of the invention.

FIG. 6 illustrates such an arrangement using a cross-sectional view similar to FIG. 2. The cross-section of the electrodes 54 is shaped such that their back face lies flush with the vessel wall 52. 53 denotes the input port. With this arrangement it may be more convenient to make electrical connections to the electrodes to the back face of the electrodes through the vessel wall; with suitable sealing arrangements. This allows for a smoother surface transition between the inlet and outlet ports and reduces the possibility of solids in suspension lodging around the electrodes. This is clearly of paramount importance with viscous or solid-bearing fluids.

Although in the embodiments described hereinabove a three phase electric power supply is used, the present invention is applicable to a power supply having any number of phases. It will be evident to a skilled person in the art that the present invention also includes an arrangement which uses a single phase electricity supply. Using a single phase connected to a centre tap transformer two phases in antiphase can be provided for supply to two electrodes.

What is claimed is:

1. An ohmic heater for heating a fluid comprising a vessel having inlet and outlet ports at opposite ends thereof, on a common axis and between which said fluid flows when in use, along an axis;

at least two electrodes arranged to be equally spaced about said axis of flow and contained within said vessel, such that the separation of said electrodes is substantially greater than the diameter of said inlet and outlet ports;

means to supply a single phase of an electric power supply to each said electrode such that the electric potential at any time along said axis and at said inlet and outlet ports is substantially at a neutral potential of the electric power supply;

an electrically conductive guard ring exposed to the flow of fluid positioned around the inner periphery of each said port;

means to electrically connect said guard rings to a neutral point of the electric power supply; and means to monitor the leakage current between said guard rings and said neutral point.

2. An ohmic heater as claimed in claim 1 wherein said vessel is electrically insulating.

3. An ohmic heater as claimed in claim 2 wherein each said electrode has a back surface adjacent to the wall of said vessel.

4. An ohmic heater as claimed in claim 1 wherein said electrodes are arranged to extend parallel to said axis.

5. An ohmic heater as claimed in claim 1 wherein said electrodes are arranged such that their separation transverse to said axis increases along said axis in the direction of flow of said fluid.

6. An ohmic heater as claimed in claim 1 comprising three said electrodes, wherein said means to supply is adapted to supply each of said electrodes with a single phase of a three-phase supply.

7. An ohmic heater as claimed in claim 1 wherein said means to supply is responsive to said means to monitor to disconnect the supply of power to said electrodes when the leakage current detected exceeds a predetermined threshold.

8. An ohmic heater as claimed in claim 1 wherein the surface of part of each of the electrodes is covered with a movable insulating material.

9. An ohmic heater as claimed in claim 1 wherein said vessel is arranged such that the flow of fluid is against gravity.

10. An ohmic heater as claimed in claim 1 comprising at least two said vessels co-axially coupled wherein the spacing of said electrodes is greater in successive said vessels along the direction of flow of said fluid.

11. An ohmic heater as claimed in claim 10 wherein electrodes in geometrically equivalent positions in each said vessel are electrically connected together.

12. An ohmic heater as claimed in claim 1 including means to electrically connect said guard rings and said neutral point to earth.

13. An ohmic heater as claimed in claim 1, further including a second electrically conductive guard ring positioned around the periphery of each of said ports at positions further from said electrodes than said electrically conductive guard rings; and means to electrically connect said second electrically conductive guard rings to earth.

14. An ohmic heater for heating a fluid, comprising:

a vessel having an inlet port and an outlet port between which said fluid flows when in use, along an axis;

three electrodes equally spaced about said axis and contained within said vessel;

means to supply a single phase of a three phase power supply to each electrode;

an electrically conductive guard ring exposed to the flow of fluid positioned around the inner periphery of each of said inlet port and said outlet port;

means to electrically connect said guard rings to a neutral point of the three phase power supply; and means to monitor the leakage current between said guard rings and said neutral point.

15. An ohmic heater for heating a fluid, comprising:

a vessel having an inlet port and an outlet port at opposite ends of said vessel;

said ports being arranged on a common axis extending longitudinally through said vessel and the interior of said vessel tapering in diameter to said ports;

three electrodes equally spaced about said axis and contained within said vessel at positions remote from said axis;

means to supply a single phase of a three phase power supply to each said electrode;

an electrically conductive guard ring exposed to the flow of fluid positioned around the inner periphery of each of said ports;

means to electrically connect said guard rings to a neutral point of the three phase supply; and means to monitor the current between said guard rings and said neutral point to provide a measure of the heater leakage current.

16. A method of operating an ohmic heater, comprising the steps of:

a) passing a fluid to be heated through an inlet port of a vessel, along a flow axis through said vessel and out of an outlet port, said inlet port and said outlet port being arranged at opposite ends of said vessel and on said flow axis;

b) energising each of a plurality of electrodes spaced about said flow axis using a single phase of an electric power supply such that the electric potential at any time on said axis and at the inlet port and the outlet port is substantially at the neutral potential of the electric power supply;

c) connecting an electrically conductive guard ring to the neutral potential of the electric power supply, which electrically conductive guard ring is exposed to the flow of said fluid and positioned around the periphery of each of said ports; and d) monitoring the current to and from said electrically conductive guard rings.

17. A method of operating an ohmic heater as claimed in claim 16, further including the step of connecting to earth a second electrically conductive guard ring positioned around the inner periphery of each of said ports at a position further from said electrodes than said guard rings.

18. A method of operating an ohmic heater as claimed in claim 16, wherein current between said electrodes is varied by adjusting the position of an insulating material partially covering the surface of said electrodes.

19. A method as claimed in claim 16 including the step of disconnecting the supply of power to said electrodes when the current detected flowing to or from said guard rings exceeds a predetermined threshold.

20. A method as claimed in claim 16 including the step of electrically connecting said guard rings to earth.

* * * * *